US006416203B1

(12) United States Patent
Fan Wong

(10) Patent No.: US 6,416,203 B1
(45) Date of Patent: Jul. 9, 2002

(54) STRUCTURE OF AN ORNAMENTAL LIGHT BULB

(76) Inventor: Tsui-Tuan Fan Wong, 15th Fl.-D, No. 81, Sec. 1, Hsintai 5th Rd., Hsitzu Chen, Taipei Hsien (TW)

( * ) Notice: Subject to any disclaimer, the term of this patent is extended or adjusted under 35 U.S.C. 154(b) by 0 days.

(21) Appl. No.: 09/699,525

(22) Filed: Oct. 30, 2000

Related U.S. Application Data

(63) Continuation-in-part of application No. 09/312,174, filed on May 14, 1999, now abandoned.

(51) Int. Cl.[7] ..... F21V 31/00
(52) U.S. Cl. ..... 362/310; 362/267
(58) Field of Search ..... 362/158, 267, 362/310, 390, 311; 313/318.01

(56) References Cited

U.S. PATENT DOCUMENTS 4,190,976 A * 3/1980 Hurt ..... 362/267
4,293,847 A * 10/1981 McCarty ..... 362/267
4,312,028 A * 1/1982 Hamacher ..... 362/390
4,665,470 A * 5/1987 George, Jr. ..... 362/390
5,700,082 A * 12/1997 Peng ..... 362/226
5,746,642 A * 5/1998 Grapp ..... 446/438
5,765,941 A * 6/1998 Vest ..... 362/390
5,821,681 A * 10/1998 Wynn ..... 362/310
5,842,779 A * 12/1998 Siebert ..... 362/309
5,848,839 A * 12/1998 Savage, Jr. ..... 362/267
6,123,433 A * 9/2000 Chen ..... 362/226

* cited by examiner

*Primary Examiner*—Thomas M. Sember
(74) *Attorney, Agent, or Firm*—Thomas, Kayden, Horstemeyer & Risley LLP

(57) ABSTRACT

An ornamental light bulb has a pair of electrical wires, a bulb electrically connected with the bulb and an enclosure securely formed outside of the connected bulb and the electrical wires. The enclosure is formed by molding or injection molding, such that the components inside the enclosure are protected and the entire bulb structure is waterproof.

2 Claims, 6 Drawing Sheets

STRUCTURE OF AN ORNAMENTAL LIGHT BULB

CROSS REFERENCE

This application is a continuation-in-part (CIP) of the patent application No. 09/312,174 filed on May 14, 1999 by the same applicant, now abandoned.

BACKGROUND OF THE INVENTION

1. Field of the Invention

The present invention relates to the structure of an ornamental light bulb, particularly to a light bulb having an integral housing provided to prevent a short in the electrical wires and water leakage.

2. Description of Related Art

As shown in FIG. 6, an ornamental light bulb normally has a pair of electrical wires (40), a bulb (42), a layer of glue (43), a first isolation tube (44) and a second isolation tube (45). The bulb (42) is electrically connected to the distal ends of the electrical wires (40). The layer of glue (43) is applied around the electrical wires (40). The first isolation tube (44) is held securely by the glue (43) and encloses the distal ends of the electrical wires (40). The second isolation tube (45) is securely connected to the first isolation tube (44). After attaching the first isolation tube (44) to the second isolation tube (45), the bulb (42) partially extends from one end of the first and second isolation tubes (44, 45). Because the layer of glue (43) securely holds the first isolation tube (44) and the second isolation tube (45) is securely connected to the first isolation tube (44), the ornamental light bulb is waterproof. However, the assembly of the ornamental light bulb requires a lot of manual labor and is labor intensive.

The invention provides an ornamental light bulb having an injection molded closure securely enclosing the bulb and the electrical wires to overcome the aforementioned problems.

SUMMARY OF THE INVENTION

The main objective of the present invention is to provide an ornamental light bulb that can be assembled without manual labor. The light bulb has an injection molded enclosure securely enclosing the bulb and the electrical wires to eliminate the need for manual assembly.

A further objective of the invention is to provide an enclosure that is integrally formed with the attached bulb and the electrical wire, such that manual assembly of the ornamental light bulb is unnecessary and the cost is greatly reduced.

The features of the present invention will be apparent in the detailed description with appropriate reference to the accompanying drawings.

DETAILED DESCRIPTION OF PREFERRED EMBODIMENT

Figure 1:
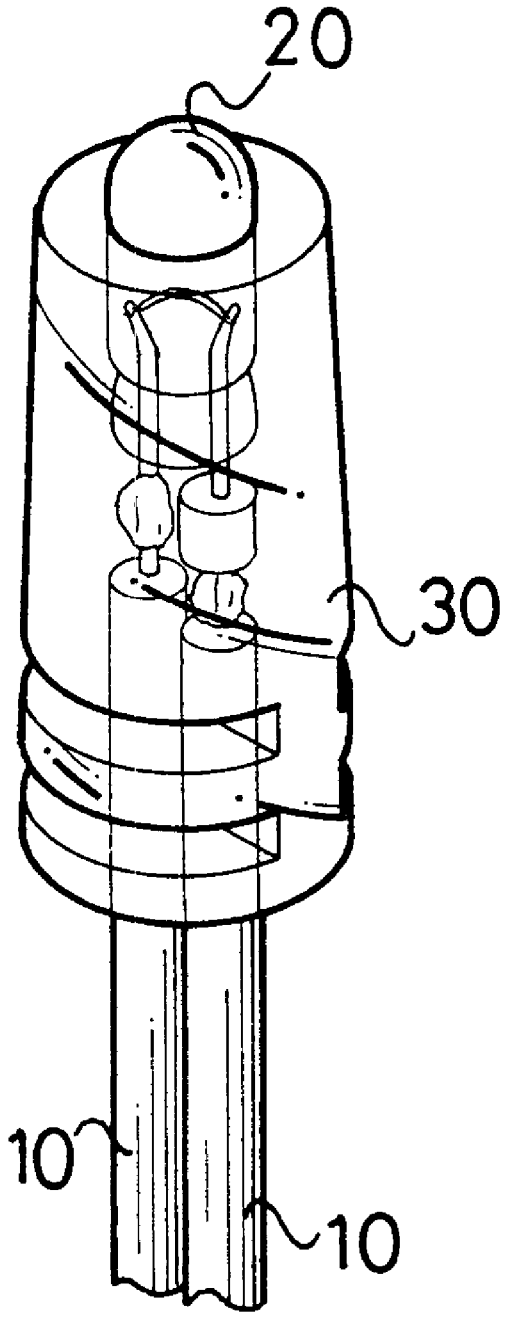
FIG. 1 is a perspective view of an ornamental light bulb in accordance with the present invention.
Figure 2:
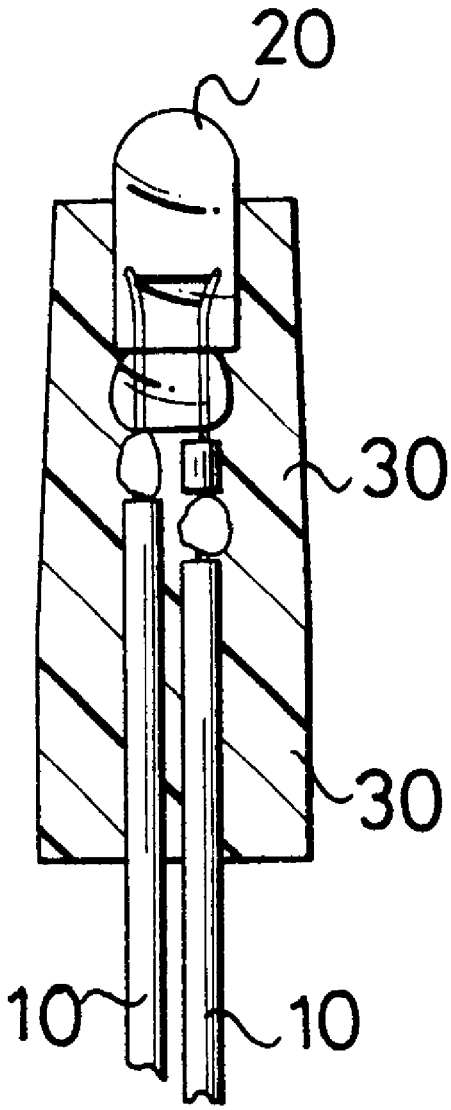
FIG. 2 is a side view in partial section of the bulb in FIG. 1, showing the relationship between the enclosure and the attached bulb and the electrical wires.

The present invention relates to an ornamental light bulb. As shown in FIGS. 1 and 2, the ornamental light bulb in accordance with the invention has a pair of electrical wires (10), a bulb (20) and an enclosure (30). The bulb (20) is electrically connected to the distal ends of the electrical wires (10). The enclosure (30) is integrally formed outside of the attached bulb (20) and the electrical wires (10).

The connection between the electrical wires (10) and the bulb (20) is conventional. Therefore, a detailed description of the connection is not provided.

After the connection between the electrical wires (10) and the bulb (20), the bulb (20) and the attached electrical wires (10) are inserted into a mold (not shown) full of liquid polyvinyl chloride (PVC). When the PVC in the mold cures and is shaped, the bulb (20) together with a portion of the electrical wires (10) are securely enclosed by a transparent of PVC enclosure (30). Because the enclosure (30) is molded or injection molded, the components inside the enclosure (30) are sealed, such that not only are the components inside the enclosure (30) protected, but the entire assembly is waterproof.

Figure 3:
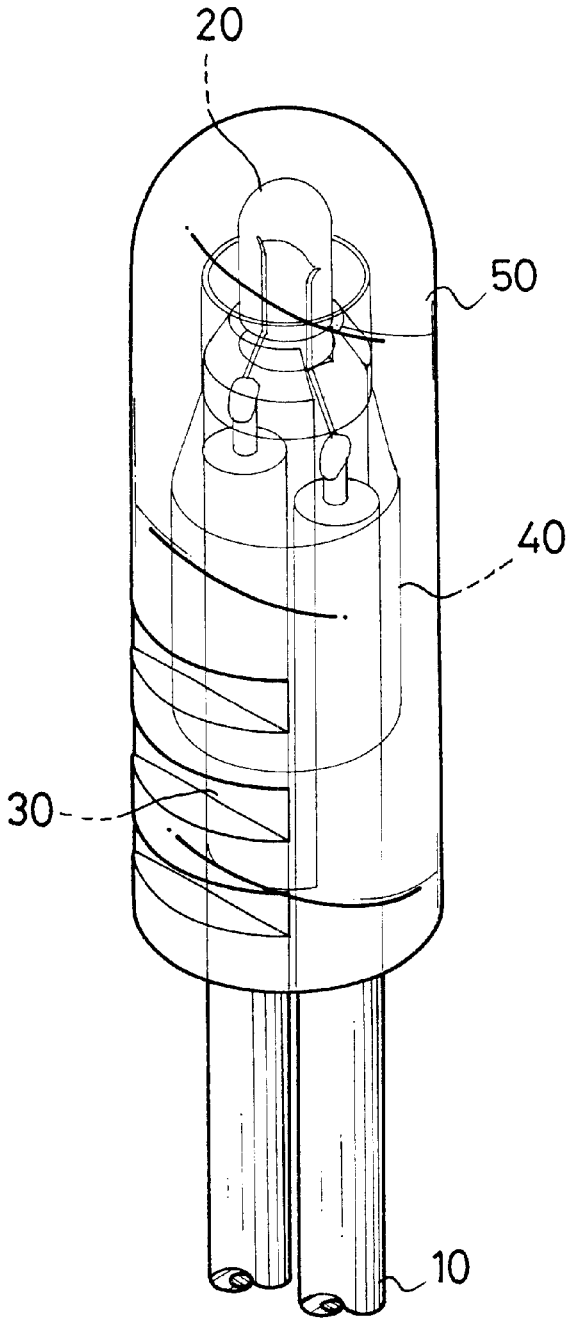
FIG. 3 is a perspective view of another preferred embodiment constructed in accordance with the present invention.
Figure 4:
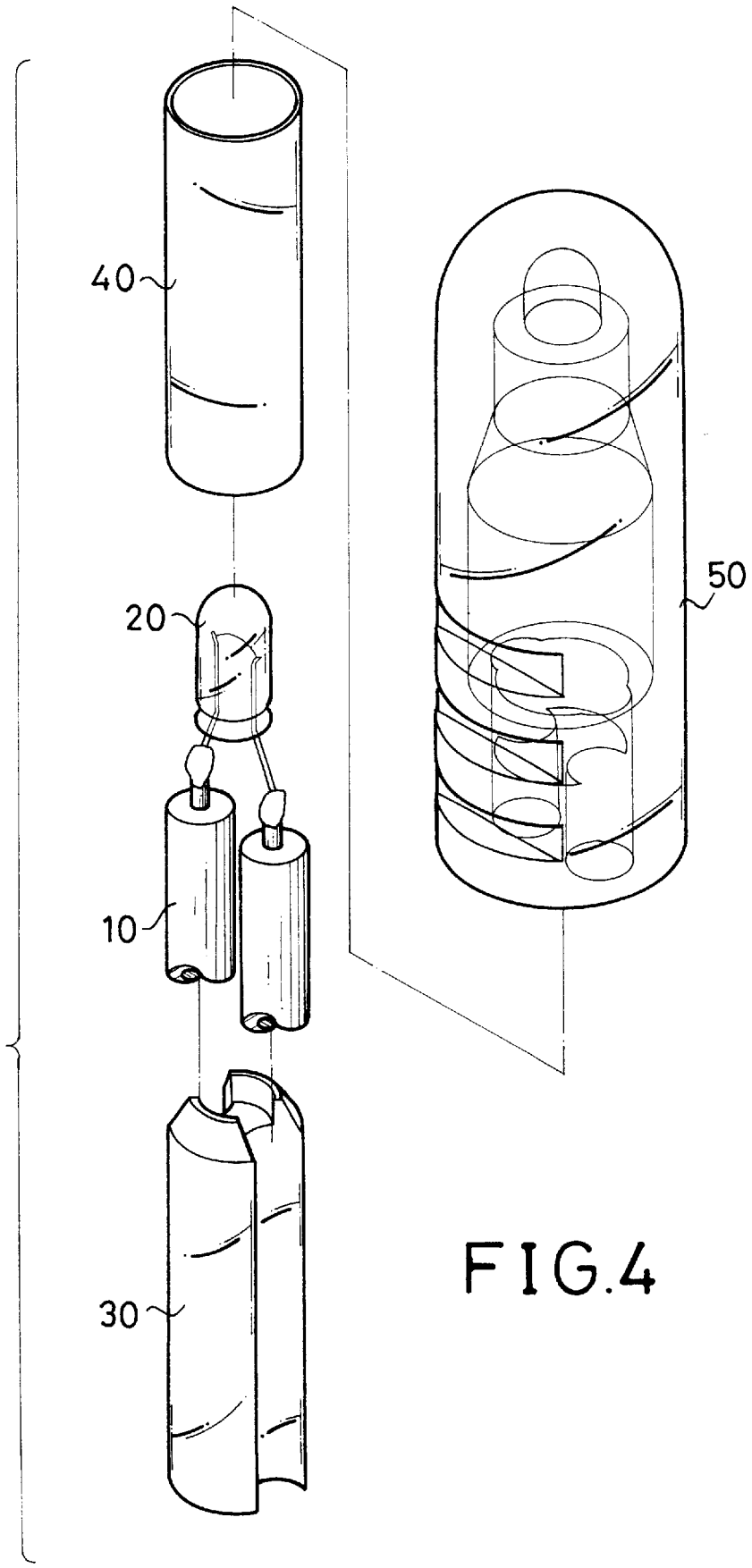
FIG. 4 is an exploded perspective view of the ornamental light bulb in FIG. 3.
Figure 5:
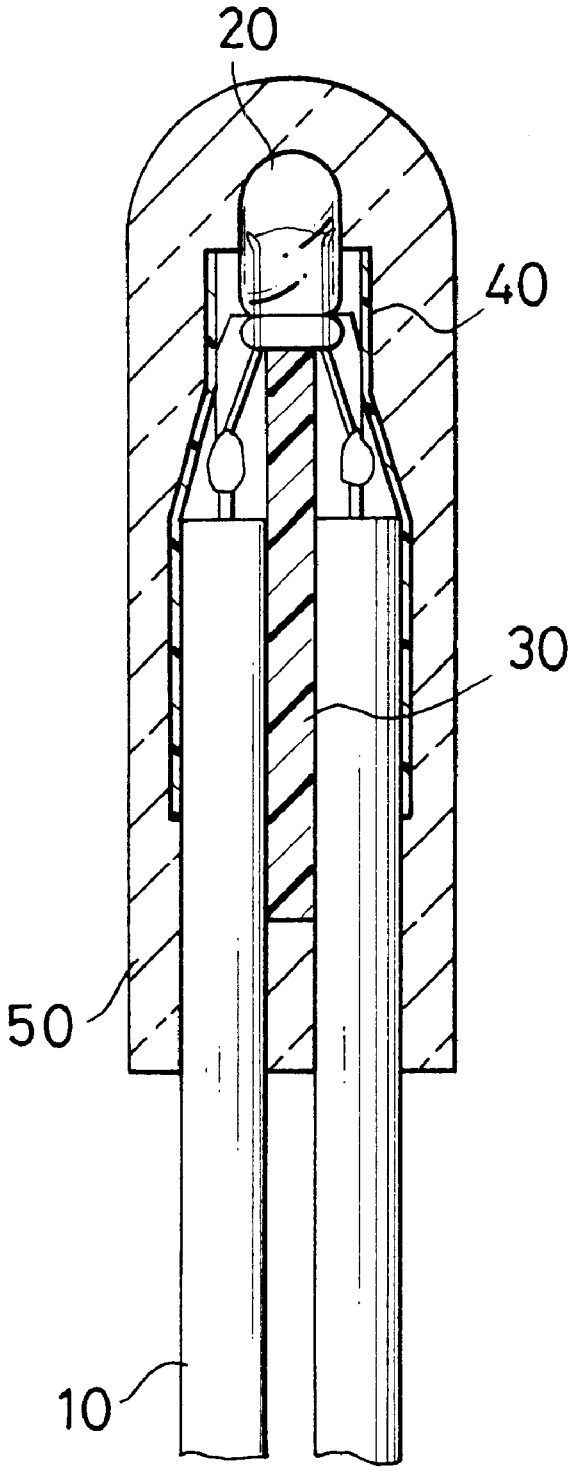
FIG. 5 is a side plan view in partial section showing that the light bulb of the embodiment is entirely enclosed.
Figure 6:
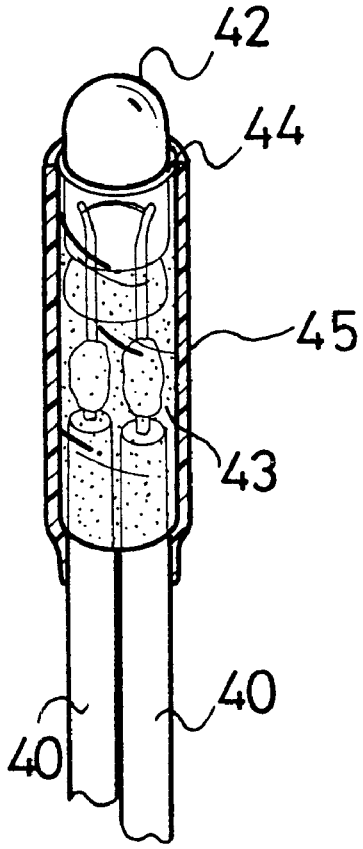
FIG. 6 PRIOR ART
FIG. 6 is a perspective view of the structure of a conventional ornamental light bulb.

As shown in FIGS. 3 and 4, another preferred embodiment of the ornamental light bulb in accordance with the invention has a pair of electrical wires (10), a bulb (20), a wire guide (30), a protective tube (40) and an enclosure (50). The bulb (20) is electrically connected to the distal ends of each of the electrical wires (10). The wire guide (30) is securely mounted between the electrical wires (10) to hold the wires (10) and prevent a short between the wires (10). The protective tube (40) surrounds the outside of the assembled electrical wires (10), the bulb (20) and the wire guide (30). The enclosure (50) is integrally formed outside of the attached bulb (20) and the electrical wires (10).

Again, the connection between the electrical wires (10) and the bulb (20) is conventional. Therefore, a detailed description is not provided.

When the connection between the bulb (20) and the electrical wires (10) is finished, the wire guide (30) is then inserted between the two electrical wires (10) such that a short between the electrical wires (10) is avoided. After the assembly of the electrical wires (10), the bulb (20) and the wire guide (30), the protective tube (40) is placed around the assembly and is heated to surround and secure the assembly. Thereafter, the bulb (20) with the electrical wires (10) as well as the wire guide (30) and the film (40) is inserted into a mold (not shown) full of liquid polyvinyl chloride (PVC). When the PVC in the mold cures and is shaped, the bulb (20), a portion of the electrical wires (10) together with the wire guide (30) and the film (40) are entirely and securely enclosed by a layer of transparent PVC enclosure (50). Because the enclosure (50) is molded or injection molded, the components inside the enclosure (50) are sealed, such that not only are the components inside the enclosure (50) protected, but the entire assembly is waterproof.

The present invention has the following advantages:

1. Easy Assembly:

Using automation to connect the bulb (20) with the electrical wires (10) is conventional. Then, the only process left is to move the bulb (20) and the electrical wires (10) into a mold full of liquid PVC and wait for the PVC to cure. This can also be performed using automation.

2. Cost Reduction:

Due to the formation of the enclosure (30), manual labor is reduced to the minimum. Thus, the cost for production is greatly reduced.

3. Waterproof:

The bulb assembly enclosed by transparent PVC is inherently waterproof.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An ornamental light bulb comprising two electrical wires (10);

a bulb (20) electrically connected to distal ends of the electrical wires (10);

a wire guide (30) securely inserted between the electrical wires (10);

a protective tube (40) securely surrounding the outside of the assembled two electrical wires (10), the bulb (20) and the wire guide (30); and an enclosure (50) formed by injection molding and entirely and securely formed outside of the connected bulb (20), the electrical wires (10), the wire guide (30) and the protective tube (40).

2. The structure as claimed in claim 1 wherein said enclosure (50) is transparent.

* * * * *